US009506669B2

(12) United States Patent
Kim

(10) Patent No.: US 9,506,669 B2
(45) Date of Patent: Nov. 29, 2016

(54) SOLID FUEL BOILER

(71) Applicant: Dae Kyoum Kim, Gwangmyeong-si (KR)

(72) Inventor: Dae Kyoum Kim, Gwangmyeong-si (KR)

( * ) Notice: Subject to any disclaimer, the term of this patent is extended or adjusted under 35 U.S.C. 154(b) by 0 days.

(21) Appl. No.: 14/903,555

(22) PCT Filed: Aug. 20, 2014

(86) PCT No.: PCT/KR2014/007712
§ 371 (c)(1),
(2) Date: Jan. 7, 2016

(87) PCT Pub. No.: WO2015/068938
PCT Pub. Date: May 14, 2015

(65) Prior Publication Data

US 2016/0169551 A1 Jun. 16, 2016

(30) Foreign Application Priority Data

Nov. 6, 2013 (KR) ..... 10-2013-0134294

(51) Int. Cl.

| | |
|---|---|
| ***F24H 1/00*** | (2006.01) |
| ***F24H 1/43*** | (2006.01) |
| ***F23B 40/02*** | (2006.01) |
| ***F23G 5/12*** | (2006.01) |
| ***F23G 7/10*** | (2006.01) |
| ***F24H 1/36*** | (2006.01) |
| ***F24H 1/24*** | (2006.01) |
| ***F24H 9/00*** | (2006.01) |

(52) U.S. Cl.

CPC ..... *F24H 1/0063* (2013.01); *F23B 40/02* (2013.01); *F23G 5/12* (2013.01); *F23G 7/10* (2013.01); *F24H 1/24* (2013.01); *F24H 1/36* (2013.01); *F24H 1/43* (2013.01); *F24H 9/0031* (2013.01); *F23G 2900/7012* (2013.01); *F24H 2230/02* (2013.01)

(58) Field of Classification Search

CPC ..... F24H 1/00; F24H 2230/00
USPC ..... 122/15.1, 16.1, 18.1, 53, 114, 118, 119, 122/124, 223, 225 B, 235.26, 22
See application file for complete search history.

(56) References Cited

U.S. PATENT DOCUMENTS

| | | | | |
|---|---|---|---|---|
| 4,393,814 | A * | 7/1983 | Sievert | F22B 31/04 122/2 |
| 4,479,605 | A * | 10/1984 | Billotte | F24D 11/003 122/16.1 |
| 4,555,993 | A * | 12/1985 | Gallaro | C10J 3/16 110/234 |
| 8,011,329 | B2 * | 9/2011 | Hardy | F23B 30/00 122/16.1 |
| 8,656,868 | B2 * | 2/2014 | Ungaro | F24H 1/40 122/211 |
| 2010/0251973 | A1 * | 10/2010 | Dongo | F23B 40/08 122/14.1 |

FOREIGN PATENT DOCUMENTS

| | | | |
|---|---|---|---|
| KR | 20-1998-0059380 | U | 10/1998 |
| KR | 10-0267042 | B1 | 9/2000 |
| KR | 20-0208703 | Y1 | 1/2001 |
| KR | 20-0350607 | Y1 | 5/2004 |
| KR | 10-2010-0069208 | A | 6/2010 |
| KR | 10-2013-0077345 | A | 7/2013 |

* cited by examiner

*Primary Examiner* — Gregory A Wilson
(74) *Attorney, Agent, or Firm* — Novick, Kim & Lee, PLLC; Jae Youn Kim

(57) ABSTRACT

The present invention relates to a solid fuel and, more particularly, to a solid fuel boiler which uses, as a heat source, solid fuel including rice straws, fallen leaves, trees, etc. and can receive oil fuel and gas fuel so as to keep a fire alive.

8 Claims, 3 Drawing Sheets

SOLID FUEL BOILER

BACKGROUND OF THE INVENTION

Field of the Invention

The present invention relates to a solid fuel and, more particularly, to a solid fuel boiler which uses, as a heat source, a solid fuel including rice straws, fallen leaves, trees, etc. and can receive oil fuel and gas fuel so as to keep a fire alive.

Related Art

In general, a boiler is a device where a burner is ignited and operated by a control system in an electrical spark scheme to heat a water tank which is circulated for hot water and heating. The fuel uses oil or gas as a fuel.

In a case of the boiler using the oil or the gas as a main fuel, since a cost due to purchase of the fuel is excessively consumed so that a maintenance cost is great. In a farm village having a low income level, the burden due to the use of the boiler is substantially increased.

A fire wood burner using rice straws, fallen leaves, and trees as a heat source is disclosed in Korean Patent Number 10-868985.

However, although the above fire wood burner uses rice straws, fallen leaves, and trees as a heat source, the fire wood burner cannot serve as a boiler.

SUMMARY OF THE INVENTION

The present invention has been made in view of the above problems, and provides a solid fuel boiler which may be replaced as a boiler using rice straws, fallen leaves, and trees as a heat source, may prevent environmental pollution, and may save energy by recycling natural resources such as rice straws, fallen leaves, chaffs, and trees.

The above information disclosed in this background section is only for enhancement of understanding of the background of the invention.

In accordance with an aspect of the present invention, there is provided a solid fuel boiler for receiving and combusting a solid fuel from an exterior to heat a hot water and a heating water, the solid fuel boiler including: a combustion furnace including an open top portion, provided therein with an inlet port in which the solid fuel is introduced and an outlet port for exhausting ash created by combusting the solid fuel, and combustion gas being exhausted to the open top portion; a plate part located inside the combustion furnace so that the solid fuel supplied into the inlet port is positioned on the plate part to be combusted; two fuel supply parts for supplying an oil fuel and a gas fuel to an inside of the combustion furnace, respectively; and a boiler part located at an upper portion of the combustion furnace to heat the hot water and the heating water by heat generated by combusting the solid fuel.

The solid fuel boiler may further include a distribution part for uniformly distributing the solid fuel introduced into the inlet port to the inside of the combustion furnace, wherein the distribution part may include: a rotation shaft located at a rear direction of the inlet port to be rotatably fixed to an inner side of the combustion furnace; and a rotation member press-fitted into the rotation shaft and including a plurality of distribution blades which are radially formed.

The plate part may include: a plate rotatably fixed inside the combustion furnace and formed therein with a plurality of holes; and a drive motor for transferring a rotating force to the plate.

The boiler part may include: a casing located at the upper portion of the combustion furnace, a storage space being formed at an inner side of the casing, a plurality of exhaustion holes communicating with the combustion furnace through the storage space, the cashing being connected to a heating water introduction pipe where the hot water from the exterior is introduced into the storage space and a heating water exhaustion pipe for exhausting the introduced hot water; and a hot water pipe where cool water is introduced to an end of the hot water pipe, cool water being introduced to an opposite end of the hot water pipe to be heated so that a hot water is exhausted, the storage space being received between the end and the opposite end of the hot water pipe.

The solid fuel boiler may further includes a connection part for connecting the combustion furnace with the boiler part, wherein the connection part comprises a water jacket which is formed therein with a connection hole being vertically open, the upper portion of the combustion furnace being coupled with an inner side of the connection hole, and a receiving space being formed at an outer side of the connection hole and including an open top portion at an inner side of the water jacket, the water jacket is connected to a heating water introduction pipe in which the heating water from the exterior is introduced into the receiving space, and wherein the boiler part may include: a casing formed therein with a plurality of exhaustion holes communicating with the connection hole, a storage space communicating with the receiving space being formed at an inner side of the casing so that the heating water from the receiving space is introduced into the storage space, and a heating water exhaustion pipe for exhausting the introduced hot water being connected to the casing; and a hot water pipe where cool water is introduced to an end of the hot water pipe, cool water is introduced to an opposite end of the hot water pipe to be heated so that a hot water is exhausted, the storage space being received between the end and the opposite end of the hot water pipe.

The solid fuel boiler may further include an exhaustion part for exhausting the combustion gas passed through the plurality of exhaustion holes to the exterior, wherein the exhaustion part may include an exhaustion pipe extending in directions of both ends of the exhaustion pipe, an exhaustion hopper connected to an upper portion of the casing to cover the plurality of exhaustion holes and to connect the casing with the exhaustion pipe; and a blowing fan connected to the exhaustion pipe.

The solid fuel boiler may further include an ash collector provided at a lower portion of the outlet port to collect ash exhausted through the plurality of holes, wherein the combustion furnace is formed therein with an ash outlet port for removing the ash accumulated on the plate, and a separation space is formed between the plate and the combustion furnace to push the ash accumulated on the plate to be exhausted to the exterior.

The connection hole may include: a first connection hole into which the upper portion of the combustion furnace is press-fitted; and a second connection hole located between the first connection hole and the boiler part and having a diameter smaller than a diameter of the first, and wherein the water jacket may include an annual stage formed between the first connection hole and the second connection hole.

Advantageous Effects

The present invention can provide a solid fuel boiler which may be replaced as a boiler using rice straws, fallen leaves, chaffs, and trees as a heat source, may prevent environmental pollution, and may save energy by recycling natural resources such as rice straws, fallen leaves, chaffs, and trees.

Effects of the present invention are not limited to the above. Other objects may be understood to skilled in the art within the scope of the present invention base on the following description.

DESCRIPTION OF EXEMPLARY EMBODIMENTS

Figure 1:
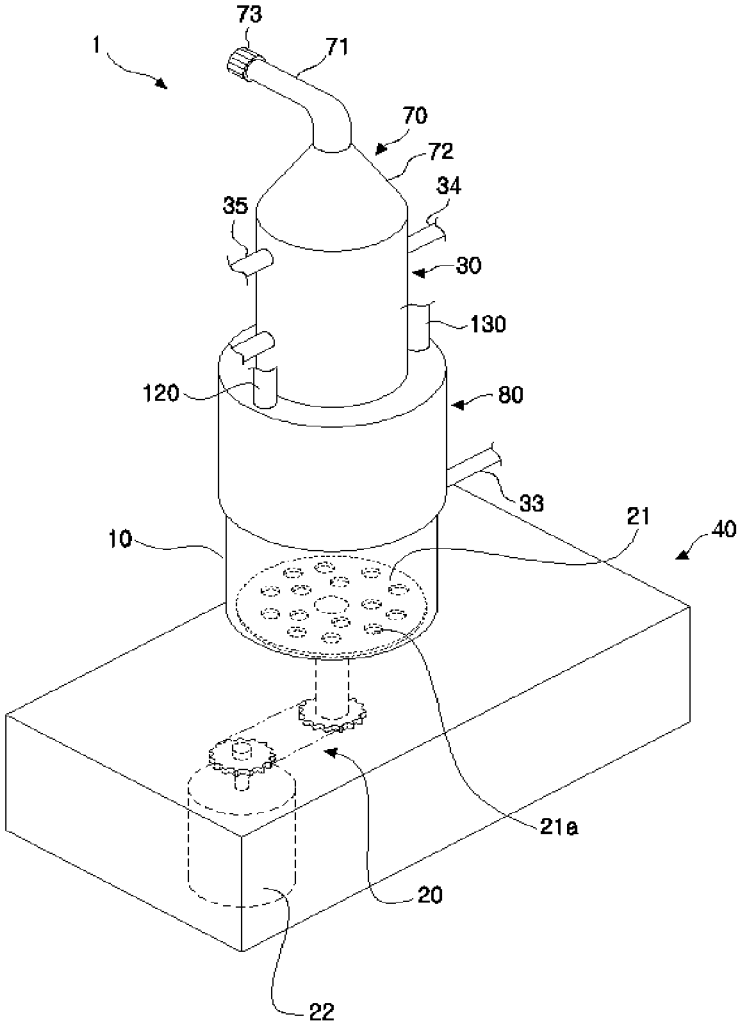
FIG. 1 is a perspective view illustrating a configuration of a solid fuel boiler according to an embodiment of the present invention.

The above objects, features, and advantages can be more clearly comprehended through the following description in relation to accompanying drawings.

Referring to FIG. 1 to FIG. 4, the solid fuel boiler 1 is a boiler which receives and combusts a solid fuel from an exterior to heat hot water and heating water, and includes a combustion furnace 10, a plate part 20, and a boiler part 30. The combustion furnace 10 is provided therein with an inlet port 11 in which the solid fuel is introduced and an outlet port 12 for exhaust ash created by combusting the solid fuel. The plate part 20 is located inside the combustion furnace 10 so that the solid fuel supplied into the inlet port 11 is positioned on the plate part 20 to be combusted. The boiler part 30 heats the hot water and the heating water by the heat provided from the combustion furnace 10.

The solid fuel may be made of rice straws, fallen leaves, sawdust, chaffs, and trees and by mixing at least two thereof.

The solid fuel is cut from an external other solid fuel supply device 100 and is supplied into the combustion furnace 10. The solid fuel supply device 100 may be configured in various known forms and a detailed description thereof is omitted.

The solid fuel boiler 1 may further include a base part 40 for supporting the combustion furnace 10. The base part 40 supports the combustion furnace 10 from an outdoor ground or an indoor bottom surface. Although the base part 40 may be configured in various known forms, it is most preferable to configure the base part 40 in a hollow hexahedron form.

The combustion furnace 10 has a cylindrical shape including an open top portion. Combustion gas created by combusting the solid fuel is exhausted in the direction of the open top of the cylindrical shape of the combustion furnace 10. Further, the outlet port 12 is formed at a lower portion of the combustion furnace 10.

The inlet port 11 communicates with an inner side of the combustion furnace 10 at a lateral side of the combustion furnace 10. Air necessary to combust the solid fuel may be introduced into the inlet port 11 together with the solid fuel.

A separate ignition device (not shown) is provided at an external bottom side of the combustion furnace 10, that is, at a lower portion of the plate part 20. The solid fuel supplied into the combustion furnace 10 through the inlet port 11 is ignited and combusted by the ignition device.

The combustion furnace 10 may be provided therein with a first fuel supply part 120 and a second fuel supply part 130 for receiving an oil fuel and a gas fuel from an exterior, respectively. The first fuel supply part 120 and the second fuel supply part 130 receive the oil fuel and the gas fuel from the exterior, respectively to supply the oil fuel and the gas fuel into the combustion furnace 10.

The first fuel supply part 120 and the second fuel supply part 130 may be configured in various known forms for receiving and supplying the oil fuel and the gas fuel from the exterior, respectively. The first fuel supply part 120 and the second fuel supply part 130 prevent fire due to an insufficient solid fuel in the combustion furnace 10 from being extinguished. In this case, the oil fuel and the gas fuel supplied from the first fuel supply part 120 and the second fuel supply part 130 may be ignited and combusted by the above separate ignition device.

In this case, the solid fuel boiler 1 may further include a distribution part 50 for uniformly distributing the solid fuel introduced into the inlet port 11 to an inside of the combustion furnace 10.

Figure 2:
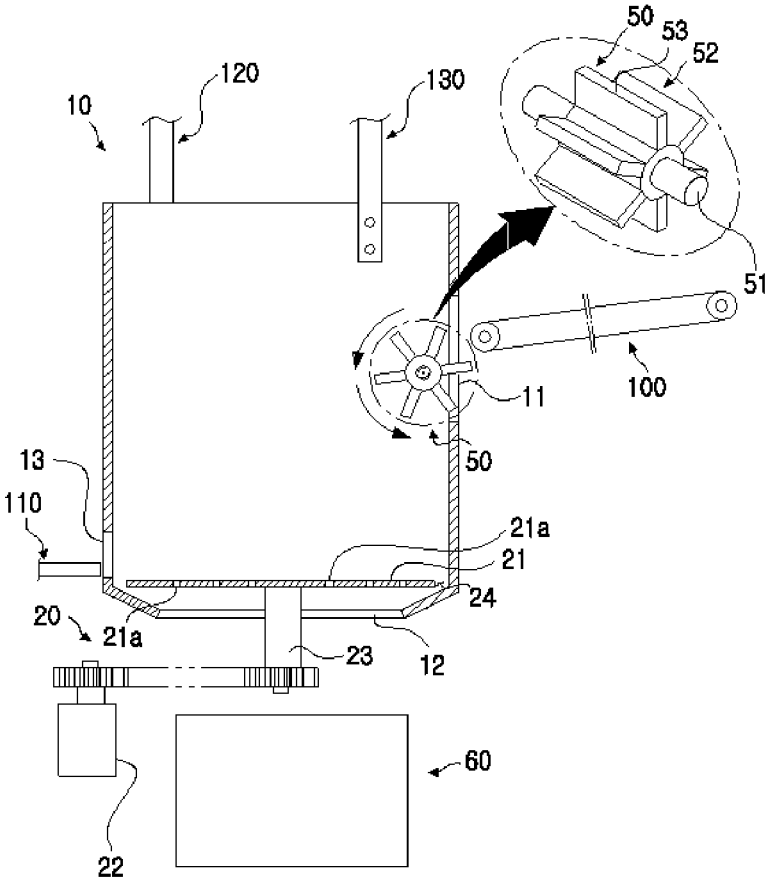
FIG. 2 is a longitudinal sectional view illustrating a combustion part of the solid fuel boiler according to an embodiment of the present invention.
Figure 3:
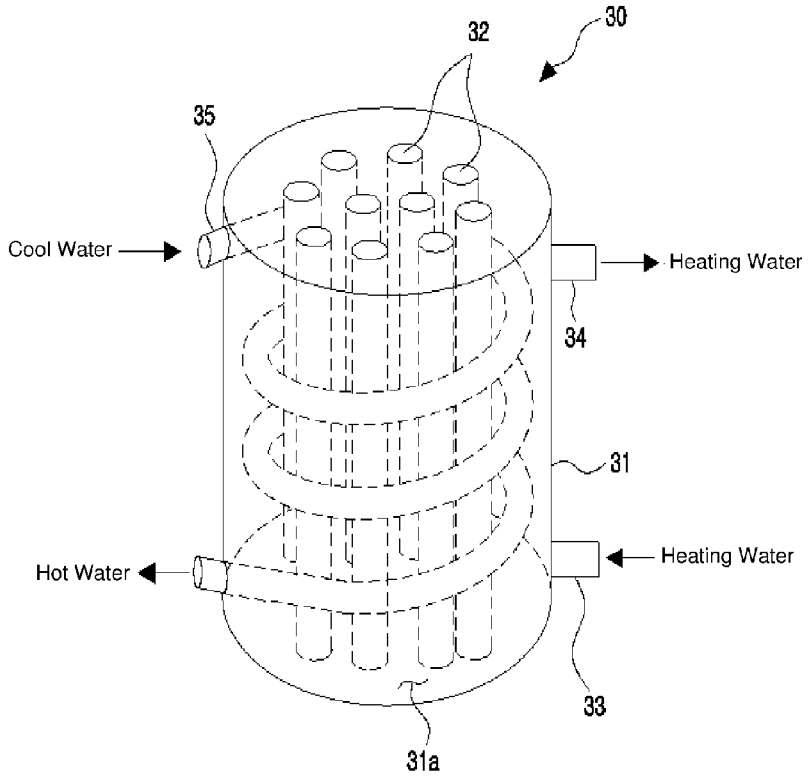
FIG. 3 is a perspective view illustrating a boiler part of the solid fuel boiler according to an embodiment of the present invention.

As shown in FIG. 2, the distribution part 50 includes a rotation shaft 51 which is located at a rear direction of the inlet port 11 and is rotatably fixed to an inner side of the combustion furnace 10, and a rotation member 52 press-fitted into the rotation shaft 51 and including a plurality of distribution wings 53 which are radially formed.

The solid fuel supply device 100 is located above the rotation shaft 51 and supplies the solid fuel between the distribution wings 53 close to each other so that the rotation member 52 is rotated to an inner direction from an outer side of the combustion furnace 10. That is, the solid fuel is received between the distribution wings 53 so that the rotation member 52 is automatically rotated by load.

In this case, the distribution part 50 may include a drive motor (not shown) for transferring a rotating force to the rotation shaft 51.

Accordingly, the solid fuel boiler 1 may uniformly distribute the solid fuel to the plate part 20 according to the rotation of the rotation member 52.

The plate part 20 includes a plate 21 rotatably fixed inside the combustion furnace 10 and a drive motor 22 for transferring a rotating force to the plate 21.

The plate 21 includes a plurality of holes 21*a* which are vertically formed to communicate with an inside of the combustion furnace 10. An external air may pass through a plurality of holes 21*a* to be introduced into the combustion furnace 10.

The drive motor 22 may be configured by a general form which receives power from the exterior to be driven. The drive motor 22 may be directly connected to the plate 21, but the present invention is not limited thereto. For example, the plate 21 includes a center shaft 23. The center shaft 23 is geared with the drive motor 22. As shown in FIG. 1 and FIG. 2, the center shaft 23 and the drive motor 22 may be connected to each other in various know forms including belt coupling.

The above is for the purpose of uniformly distributing the solid fuel to the plate 21 while accumulating the solid fuel at a predetermined point which falls through the inlet port 11.

The center shaft 23 of the plate 21 may be stably rotated by rotatably fixing the center shaft 23 to the base part 40.

The solid fuel boiler 1 may perform complete combustion of the solid fuel by uniformly distributing the solid fuel supplied from the combustion furnace 10 through the inlet port 11 by the drive of the drive motor 22.

In this case, the solid fuel boiler 1 may further include an ash collector 60 for collecting ash fallen through a plurality of holes 21*a*.

The ash collector 60 is received inside the base part 40. It is preferable that the ash collector 60 is located under the outlet port 12. Further, it is most preferable that the combustion furnace 10 has a conic shape including an internal diameter gradually reduced in the direction of the outlet port 12 from a point in which the plate 21 is located.

The above is for the purpose of retracting the ash passed through a plurality of holes 21*a* into the ash collector 60 without separation.

The combustion furnace 10 is formed therein with an ash outlet port 13 for removing the ash accumulated on the plate without being exhausted through a plurality of holes 21*a*.

The ash outlet port 13 communicates with an inside of the combustion furnace 10. A separate ash processing knife 110 is introduced to push the ash accumulated on the plate 21 to a separation space 24 between the plate 21 and the combustion furnace 10 so that the ash may be exhausted to the exterior.

In this case, it is preferable to form the separation space 24 so that the ash may be exhausted between the plate 21 and the combustion furnace 10. In addition, it is preferable that the ash processing knife 110 is introduced into the ash outlet port 13 to pressurize the ash accumulated on the plate 21 to be pushed to the separation space 24.

The boiler part 30 is located at an upper portion of the combustion furnace 10. The boiler part 30 is heated due to blaze or combustion gas having a high temperature created by combusting the solid fuel to heat the hot water which circulates inside the boiler part 30.

As shown in FIG. 1, the boiler part 30 includes a casing 31 and a hot water pipe 35. The casing 31 is located at an upper portion of the combustion furnace 10. A storage space 31*a* is formed at an inner side of the casing 31. A plurality of exhaustion holes 32 communicate with the combustion furnace 10 through the storage space 31*a*. A heating water introduction pipe 33 and a heating water exhaustion pipe 34 are connected to the casing 31. The hot water from the exterior is introduced into the heating water introduction pipe 33. The heating water exhaustion pipe 34 exhausts the introduced hot water. The hot water pipe 35 is located at an inner side of the casing 31. Cool water is introduced to an end of the hot water pipe 35. The cool water introduced to an opposite end of the hot water pipe 35 is heated so that a hot water having a high temperature is exhausted through the hot water pipe 35.

The casing 31 includes a top surface and a bottom surface. The exhaustion holes 32 are formed by forming circular pipes through the top surface and the bottom surface of the casing 31 and passing combustion gas created from the combustion furnace 10 through the exhaust holes 32.

The heating water introduction pipe 33 is connected to the casing 31 so that an end of the heating water introduction pipe 33 communicates with the storage space 31*a*. The hot water exhausted through the heating water exhaustion pipe 34 repeatedly circulates to heat an inside of a building to be reintroduced.

The above circulation is repeated so that the hot water received in the casing 31 may protect overheating of the casing 31.

The hot water introduced through the heating water introduction pipe 33 is stored in the storage space 31*a*. The blaze or combustion gas created by combusting the solid fuel make heat-contact with a plurality of exhaustion holes 32 so that the hot water is heated in a high temperate state.

The hot water pipe 35 is located at the storage space 31*a* and is heated by the hot water in the high temperature state.

It is preferable that the hot water pipe 35 is configured by a coil pipe having a general form. Both ends of the hot water pipe 35 are located at an outer side of the casing 31. The hot water pipe 35 is immersed in the hot water received in the storage space 31*a* inside the casing 31.

A plurality of exhaustion holes 32 communicate with an inside of the combustion furnace through the top surface and the bottom surface of the casing 31. The blaze or combustion gas created by combusting the solid fuel is exhausted through a plurality of exhaustion holes 32 so that heat contact is achieved.

The hot water stored inside the casing 31 is heated by the heat contact and the hot water pipe 35 is heated by the hot water heated in a high temperature state.

The hot water heated in the high temperature is connected to a separate heating pipe (not shown) through the heating water exhaustion pipe 34 to circulate, and is introduced into the casing 31 through the heating water introduction pipe 33 to be reheated.

The hot water heated in the high temperature is connected to a separate hot water pipe (not shown) to be exhausted and consumed. Cool water in a low temperature state which is not heated is continuously supplied and heated to the hot water pipe 35 through an external other water pipe (not shown).

The above circulation is repeated so that the solid fuel boiler 1 may continuously supply the hot water and the heating water according to combustion of the solid fuel.

In this case, as shown in FIG. 1, the solid fuel boiler 1 may further include an exhaustion part 70 for exhausting the combustion gas passed through a plurality of exhaustion holes 32 to the exterior.

The exhaustion part 70 includes an exhaustion pipe 71 extending in directions of both ends thereof, and an exhaustion hopper 72 connected to an upper portion of the casing 31 to cover a plurality of exhaustion holes 32 and to connect the casing 31 with the exhaustion pipe 71.

It is preferable that the exhaustion hopper 72 has a conic shape including an internal diameter gradually narrowed in the direction of the exhaustion pipe 71 from the casing 31.

The exhaustion pipe 71 may further include a blowing fan 73 for easily exhausting the combustion gas to the exterior.

Accordingly, the solid fuel boiler 1 may easily exhaust the combustion gas created by combusting the solid fuel to the exterior.

Figure 4:
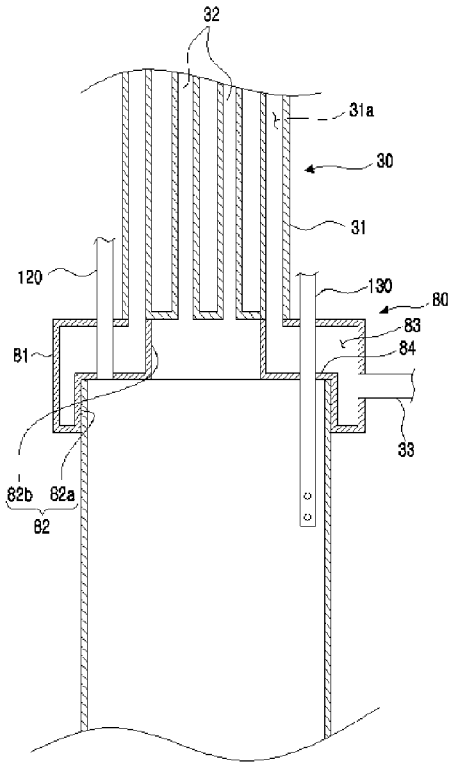
FIG. 4 is a longitudinal sectional view illustrating a connection part of the solid fuel boiler according to an embodiment of the present invention.

As shown in FIG. 1 and FIG. 4, the solid fuel boiler 1 may include a connection part 80 for connecting the combustion furnace 10 with the boiler part 30 and for preventing overheating of the boiler part 30.

The connection part 80 includes a water jacket 81. The water jacket 81 is formed therein with a connection hole 82 which is vertically open. An upper portion of the combustion furnace 10 is coupled with an inner side of the connection hole 82. A receiving space 83 is formed at an outer side of the connection hole 82 and includes an open top portion at an inner side of the water jacket 81.

The water jacket 81 has an annual ring shape. The boiler part 30 is connected to an upper portion of the water jacket 81 by welding so that the storage space 31*a*, the receiving space 83, a plurality of exhaustion holes 32, and the connection hole 82 communicate with each other.

In this case, it should be understood that the heating water introduction pipe 33 is connected to the connection part 80 instead of the casing 31. That is, the hot water received in the storage space 31*a* circulates by being exhausted through the heating water exhaustion pipe 34, and is introduced into the receiving space 83 through the heating water introduction pipe 33 to be reheated.

The connection hole 82 may include a first connection hole 82*a* into which an upper portion of the combustion furnace is press-fitted and a second connection hole 82*b* located between the first connection hole 82*a* and the boiler part 30.

In the water jacket 81, an internal diameter of the first connection hole 82*a* is greater than an internal diameter of the second connection hole 82*b* so that an annual stage 84 may be formed between the first connection hole 82*a* and the second connection hole 82*b*. The annual stage 84 may be positioned at the upper portion of the combustion furnace 10 to be stably fixed to the upper portion of the combustion furnace 10.

The annual stage 84 may increase blaze provided from the combustion furnace 10 or a heat contact area with the combustion gas having a high temperature and limits a flow of the combustion gas to increase a time when the combustion gas stays in the combustion furnace 10. In other words, the annual stage 84 prevents the combustion gas and the like from being rapidly exhausted to the exterior so that an internal temperature may maintain in a high temperature state.

The receiving space 83 connected to the storage space 31*a* of the casing 31 to communicate with the storage space 31*a* of the casing 31 by the heating water introduction pipe 33 to receive the heating water. When the blaze or the combustion gas created by combusting the solid fuel is introduced into the connection hole 82, the received heating water is heated.

Since the connection part 80 is connected between the combustion furnace 10 and the boiler part 30 and the heating water is stored at an inner side of the connection part 80, the solid fuel boiler 1 may prevent overheating due to heat generated by combusting the solid fuel.

The solid fuel boiler according to an embodiment of the present invention will be described with reference to FIG. 1 to FIG. 4. The connection part 80 is connected so that the connection hole 82 communicates with an inner side of the combustion furnace 10. The connection part 80 is connected to a plurality of exhaustion holes 32 included in the boiler part 30 while communicating with the exhaustion holes 32.

The solid fuel supplied into the combustion furnace 10 through the introduction hole 11 is uniformly distributed to the plate 21 according to drive of the distribution part 50 and the drive motor 22 and is ignited according to a separate ignition device.

The blaze or the combustion gas created by combustion fuel is introduced into the connection hole 82 through the combustion furnace 10. When the blaze or the combustion gas is introduced, the blaze or the combustion gas makes heat-contact with the connection part 80 so that the heating water received in the receiving space 83 is primarily heated.

The heating water primarily heated in the receiving space 83 is introduced into the storage space 31*a*. The introduced heating water makes heat-contact with the blaze or the combustion gas having a high temperature introduced into a plurality of exhaustion holes 32 to be secondarily heated.

Further, the heating water circulates by being exhausted through the heating water exhaustion pipe 34, and is then introduced into the receiving space 83 through the heating water introduction pipe 33 to be reheated.

By repeating the above procedure, the solid fuel boiler 1 may maintain a heating state having a constant temperature by continuously supplying the heating water in a high temperature state according to the combustion of the solid fuel.

The hot water pipe 35 is heated by a hot water heated in the storage space 31*a* so that the hot water is exhausted, and cool water from the external may be continuously supplied and compensated.

The external cool water is introduced into an end of the hot water pipe 35. The introduced cool water may be heated by the hot water in the high temperature state in the storage space 31*a* so that the hot water may be continuously exhausted to an opposite end of the hot water pipe 35.

Accordingly, the solid fuel boiler 1 may continuously heat and use the hot water and the heating water according to the combustion of the solid fuel.

Although the solid fuel boiler according to embodiments has been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

DESCRIPTION OF REFERENCE NUMERALS

*Description of Main Parts in Drawings*

| | | | |
|---|---|---|---|
| 1 | Solid fuel boiler | 10 | Combustion furnace |
| 11 | Inlet port | 12 | Outlet port |
| 13 | Ash outlet port | 20 | Plate part |
| 21 | Plate | 22 | Drive motor |
| 23 | Center shaft | 24 | Separation space |
| 30 | Boiler part | 31 | Casing |
| 31a | Storage space | 32 | Exhaustion hole |
| 33 | Heating water introduction pipe | | |
| 34 | Heating water exhaustion pipe | | |
| 35 | Hot water pipe | 40 | Base part |
| 50 | Distribution part | 52 | Rotation member |
| 60 | Ash collector | 70 | Exhaustion part |
| 80 | Connection part | 81 | Water jacket |
| 82 | Connection hole | 83 | Receiving space |
| 84 | Annual stage | | |
| 100 | Solid fuel supply device | | |
| 120,130 | Fuel supply part | | |

What is claimed is:

1. A solid fuel boiler for receiving and combusting a solid fuel supplied from an exterior to heat a hot water and a heating water, the solid fuel boiler comprising:

a combustion furnace including an open top portion, provided therein with an inlet port in which the solid fuel is introduced and an outlet port for exhausting ash created by combusting the solid fuel, and combustion gas being exhausted to the open top portion;

a plate part located inside the combustion furnace so that the solid fuel supplied into the inlet port is positioned on the plate part to be combusted;

two fuel supply parts for supplying an oil fuel and a gas fuel to an inside of the combustion furnace, respectively;

a boiler part located at an upper portion of the combustion furnace to heat the hot water and the heating water by heat generated by combusting the solid fuel; and a connection part for connecting the combustion furnace with the boiler part, wherein the connection part comprises a water jacket which is formed therein with a connection hole being vertically open, the upper portion of the combustion furnace being coupled with an inner side of the connection hole, and a receiving space being formed at an outer side of the connection hole and including an open top portion at an inner side of the water jacket, the water jacket is connected to a heating water introduction pipe in which the heating water from the exterior is introduced into the receiving space, and wherein the boiler part comprises:

a casing formed therein with a plurality of exhaustion holes communicating with the connection hole, a storage space communicating with the receiving space and being formed at an inner side of the casing so that the heating water from the receiving space is introduced into the storage space, and a heating water exhaustion pipe for exhausting the introduced hot water, being connected to the casing; and a hot water pipe where cool water is introduced to a first end of the hot water pipe and exits through a second end of the hot water pipe so that the cool water is heated to exhaust a hot water, the storage space being disposed between the first and second ends of the hot water pipe.

2. The solid fuel boiler of claim 1, wherein the plate part comprises:

a plate rotatably fixed inside the combustion furnace and formed therein with a plurality of holes; and a drive motor for transferring a rotating force to the plate.

3. The solid fuel boiler of claim 2, further comprising an ash collector provided at a lower portion of the outlet port to collect ash exhausted through the plurality of holes, wherein the combustion furnace is formed therein with an ash outlet port for removing the ash accumulated on the plate, and a separation space is formed between the plate and the combustion furnace to push the ash accumulated on the plate to be exhausted to the exterior.

4. The solid fuel boiler of claim 1, wherein the casing is located at the upper portion of the combustion furnace.

5. The solid fuel boiler of claim 1, wherein the connection hole comprises:

a first connection hole into which the upper portion of the combustion furnace is press-fitted; and a second connection hole located between the first connection hole and the boiler part and having a diameter smaller than a diameter of the first, and wherein the water jacket comprises an annual stage formed between the first connection hole and the second connection hole.

6. The solid fuel boiler of claim 1, further comprising an exhaustion part for exhausting the combustion gas passed through the plurality of exhaustion holes to the exterior, wherein the exhaustion part comprises an exhaustion pipe extending in directions of both ends of the exhaustion pipe, an exhaustion hopper connected to an upper portion of the casing to cover the plurality of exhaustion holes and to connect the casing with the exhaustion pipe; and a blowing fan connected to the exhaustion pipe.

7. A solid fuel boiler for receiving and combusting a solid fuel supplied from an exterior to heat a hot water and a heating water, the solid fuel boiler comprising:

a combustion furnace including an open top portion, provided therein with an inlet port in which the solid fuel is introduced and an outlet port for exhausting ash created by combusting the solid fuel, and combustion gas being exhausted to the open top portion;

a plate part located inside the combustion furnace so that the solid fuel supplied into the inlet port is positioned on the plate part to be combusted;

two fuel supply parts for supplying an oil fuel and a gas fuel to an inside of the combustion furnace, respectively;

a boiler part located at an upper portion of the combustion furnace to heat the hot water and the heating water by heat generated by combusting the solid fuel; and a distribution part for uniformly distributing the solid fuel introduced into the inlet port to the inside of the combustion furnace, wherein the distribution part comprises:

a rotation shaft located at a rear direction of the inlet port to be rotatably fixed to an inner side of the combustion furnace; and a rotation member press-fitted into the rotation shaft and including a plurality of distribution blades which are radially formed.

8. A solid fuel boiler for receiving and combusting a solid fuel supplied from an exterior to heat a hot water and a heating water, the solid fuel boiler comprising:

a combustion furnace including an open top portion, provided therein with an inlet port in which the solid fuel is introduced and an outlet port for exhausting ash created by combusting the solid fuel, and combustion gas being exhausted to the open top portion;

a plate part located inside the combustion furnace so that the solid fuel supplied into the inlet port is positioned on the plate part to be combusted;

two fuel supply parts for supplying an oil fuel and a gas fuel to an inside of the combustion furnace, respectively;

a boiler part located at an upper portion of the combustion furnace to heat the hot water and the heating water by heat generated by combusting the solid fuel; and an exhaustion part for exhausting the combustion gas passed through the plurality of exhaustion holes to the exterior, wherein the boiler part comprises:

a casing located at the upper portion of the combustion furnace, a storage space being formed at an inner side of the casing, a plurality of exhaustion holes communicating with the combustion furnace through the storage space, the cashing being connected to a heating water introduction pipe where the hot water from the exterior is introduced into the storage space and a heating water exhaustion pipe for exhausting the introduced hot water; and a hot water pipe where cool water is introduced to a first end of the hot water pipe and exits through a second end of the hot water pipe so that the cool water is heated to exhaust a hot water, the storage space being disposed between the first and second ends of the hot water pipe, wherein the exhaustion part comprises an exhaustion pipe extending in directions of both ends of the exhaustion pipe, an exhaustion hopper connected to an upper portion of the casing to cover the plurality of exhaustion holes and to connect the casing with the exhaustion pipe; and a blowing fan connected to the exhaustion pipe.

* * * * *